US008397334B2

(12) United States Patent
Ryffel

(10) Patent No.: US 8,397,334 B2
(45) Date of Patent: Mar. 19, 2013

(54) DEVICE AND METHOD FOR THE TREATMENT OF A CONTAINER WALL AND CONTAINER

(75) Inventor: Martin Ryffel, Horgen (CH)

(73) Assignee: Straintec AG, Wollerau (CH)

( * ) Notice: Subject to any disclaimer, the term of this patent is extended or adjusted under 35 U.S.C. 154(b) by 1141 days.

(21) Appl. No.: 12/326,396

(22) Filed: Dec. 2, 2008

(65) Prior Publication Data

US 2009/0144917 A1 Jun. 11, 2009

(30) Foreign Application Priority Data

Dec. 5, 2007 (EP) ..... 07023501

(51) Int. Cl.
*B08B 9/00* (2006.01)

(52) U.S. Cl. ..... 15/56; 15/246.5; 134/6

(58) Field of Classification Search ..... 15/56, 246.5; 134/6

See application file for complete search history.

(56) References Cited

U.S. PATENT DOCUMENTS

| | | | | |
|---|---|---|---|---|
| 3,556,252 A | | 1/1971 | Atkins | |
| 4,571,138 A | * | 2/1986 | Farajun | 414/323 |
| 5,020,183 A | | 6/1991 | Grant, Jr. | |
| 5,503,033 A | | 4/1996 | Van Niekerk | |
| 5,526,989 A | * | 6/1996 | Staples et al. | 241/25 |
| 5,594,973 A | * | 1/1997 | Brusseleers et al. | 15/304 |
| 6,213,134 B1 | * | 4/2001 | Pike | 134/166 R |

FOREIGN PATENT DOCUMENTS

| | | |
|---|---|---|
| CH | 670 248 A5 | 12/1985 |
| DE | 201 14 463 U1 | 2/2002 |
| DE | 102 56 560 A1 | 6/2004 |
| GB | 211 640 | 2/1924 |
| GB | 1 362 190 | 7/1974 |

OTHER PUBLICATIONS

European Search Report for EP 07 02 3501, Apr. 28, 2008.

* cited by examiner

*Primary Examiner* — Laura C Guidotti
(74) *Attorney, Agent, or Firm* — McCormick, Paulding & Huber LLP

(57) ABSTRACT

A device for cleaning a container, a tank or a silo, is provided with a cleaning unit suspended by rope sections and between winding units comprising a wound supply of rope. By changing the length of the sections by the winding devices under control of a controller the cleaning unit can be lifted and lowered, tilted and pressed against the inside wall of said container.

21 Claims, 4 Drawing Sheets

DEVICE AND METHOD FOR THE TREATMENT OF A CONTAINER WALL AND CONTAINER

FIELD OF THE INVENTION

The invention relates to a device for the treatment of the inner wall of a container. The invention further relates to a container including such a device and to a method for the treatment of an inner container wall.

BACKGROUND OF THE INVENTION

Devices and methods for the cleaning of the inner wall of a container, such as a food silo, are known. DE-U-201 14 463 shows a device for the cleaning of a silo wherein a carrier with two rotating brushes is lifted along the height of the silo by a rope and a winch. This device is not suitable for silos with sloping walls. DE-A-102 56 560 shows a device wherein a carriage with a tilting arm is vertically moved by a chain or a rope. This cleaning device can be used in a silo with sloping walls but seems restricted due to its construction and weight to silos of only limited diameter.

SUMMARY OF THE INVENTION

It is the object of the present invention to provide a device and a method for the inside treatment of container walls, and in particular for the inside cleaning of container walls, that is suitable for any kind of straight and sloping walls and in particular for containers of large diameters.

This object is met by a device for the treatment, and in particular the cleaning, of a container, a tank or a silo, comprising a treatment unit, and in particular a cleaning unit, suspended within the container between winding units by sections of rope-like flexible members, in particular ropes, each winding unit comprising a wound supply of said flexible members and being adapted to change the length of the sections under control of a controller, so that the cleaning unit is lifted and/or lowered and/or tilted, and pressed against the inside wall of said container, by lengthening and/or shortening said sections and tensioning at least one of said flexible members.

By these features a device with a very lightweight construction within the container results which is able to adapt to inside walls of containers of different shapes and of different sizes up to very large containers. The treatment unit, which is preferably a cleaning and in particular a dry cleaning unit, is suspended by ropes or rope-like members and is lifted, lowered and tilted by the ropes or rope-like members.

In a preferred embodiment the device comprises at least one elongated rigid holding unit, carrying the treatment unit at its one end intended to face the container inside wall and provided with a length equal or greater than the radius of the container for which the device is intended, a hanging unit, connected to the holding unit by the rope-like flexible members, and a first and a second winding unit for the flexible members intended to be arranged essentially in the longitudinal axis of the container, each providing the wound supply of said flexible members, said holding unit being held by the flexible members suspended between the first and second winding device, and wherein the position of the holding unit between the winding units and the tilt of the holding unit is adjustable by changing the length of the flexible members reaching from the winding devices to the holding unit by the control unit, and wherein the holding unit is movable in direction towards the container wall by tensioning at least one of the flexible members between the winding devices, and wherein the treatment unit is provided with a drive for displacing the treatment unit along the container wall.

The method for the treatment of inside containers walls and in particular for cleaning a container a tank or a silo, comprises the steps of suspending a cleaning unit by rope sections between winding units comprising a wound supply of rope and changing the length of the sections by the winding devices under control of a controller, so that the cleaning unit is lifted and/or lowered and/or tilted by lengthening and/or shortening said sections, and pressed against the inside wall of said container by tensioning at least one of said ropes.

The same advantages apply as for the device.

In a further embodiment of the device and method only two such flexible members are used which results in a very simple construction. In a preferred second embodiment, a third flexible member is employed, giving added stability, in particular for the pressing of the treatment unit against the container wall.

In a preferred device and method the winding units are adapted to be rigidly mounted outside of the container. In another device or method the winding units are adapted to be rigidly mounted within the container. A combination is also possible, so that one of the winding units is placed within the container and the other winding unit is located outside of the container.

The flexible members are preferably ropes, but can be belts or wires or chains as well. Preferably the winding devices comprise a central entry for the flexible members with deflection means and opposing winch means towards which the flexible members are guided by the deflection means. The treatment head is preferably a cleaning head and in particular a dry cleaning head. It may be connected to the holding unit by a spring loaded telescopic member thereof.

BRIEF DESCRIPTION OF THE DRAWINGS

The invention will be better understood and objects other than those set forth above will become apparent when consideration is given to the following detailed description of preferred embodiments of the invention by way of the drawings, wherein.

DESCRIPTION OF THE PREFERRED EMBODIMENTS

Figure 1:
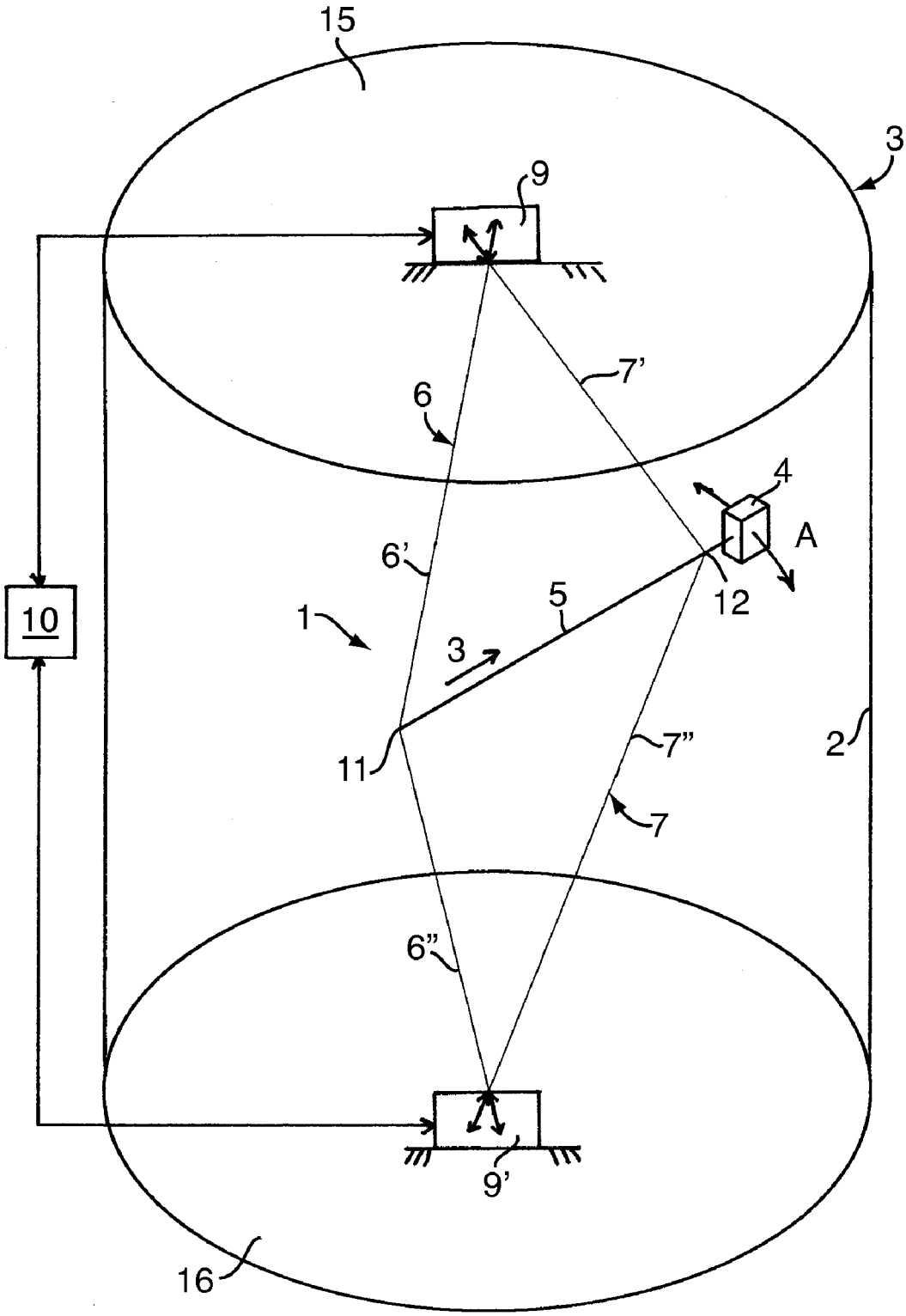
FIG. 1 is a three-dimensional simplified view of a first embodiment of the invention.

FIG. 1 shows in a schematic view a first embodiment of the invention. A container 3 with an inside wall 2 is provided with the device 1 for the treatment of the inside wall. The container is shown transparent to allow the explanation of the device and method. A treatment unit 4 of device 1 contacts the inside wall 2 and is moved along a horizontal arc indicated by arrow A along the wall by a drive arranged at the unit 4. The drive contacts the inside wall 2 for example by a driven roller or several rollers which are pressed against the wall, as will be described below, so that unit 4 is driven along the arc-shaped path by friction between the driven roller or rollers and the wall. The length of the arc will usually be 360° so that the unit 4 moves once around the inside circumference of the container; then the direction of movement of unit 4 will be reversed, so that the unit travels back 360°. This travelling backwards is done at a higher or lower position in the container, as will be explained below, so that another circumferential band is treated by unit 4. The treatment unit 4 is preferably a cleaning unit and in particular a unit for dry-cleaning, but a unit for liquid cleaning could be used as well. The dry-cleaning of the inside wall is provided in a known manner by brushes or by ejecting cleaning particles that clean the wall by abrasion. Such cleaning means are known to the man skilled in the art and will not be described here in detail. The cleaning unit will have to be provided with power and, if the case may be with cleaning substances, by electric or pneumatic or hydraulic lines respectively, which are not shown in the drawings. Such lines will connect a power source and a cleaning substance source to the cleaning unit 4 in conventional manner by such lines. These lines may follow the flexible members described later or may be brought into the container in a different manner. Instead of a cleaning unit another unit for the treatment of the inside wall 2 could be used with the device 1 according to the invention. The unit may be for example a grinder, a spray unit for colour or a coating unit for applying a coating to the wall. More than one unit 4 may be provided.

The unit 4 is arranged on an elongated holding unit 5, which is in the shown embodiments a simple rod, but which may have other shapes, for example a plate-like shape, as long as the flexible members or ropes, respectively, can be connected in a functional manner as will be explained below. This holding unit 5 is rigid and for example made of aluminium. The length of the holding unit 5 is selected to be equal or greater than the inner radius of the container. At two spaced apart points 11, 12 of the holding unit 5, and preferably at one end 11 and a point 12 near the other end on which the treatment unit 5 is fixed, the flexible members, preferably ropes, 6 and 7, respectively, are fixed to the holding unit 5. Rope 6 may be a single, one piece rope that is divided by fixation point 11 on the bar into an upper section 6' and a lower section 6". Instead, two ropes 6' and 6" may be fixed to the holding unit 5 at point 11. The same holds true for rope 7, which may be a single rope with upper section 7' and lower section 7" or may be in the form of two ropes 7' and 7" fixed to point 12 on holding unit 5. The fixation of the rope or the ropes to the unit or rod 5 may be made with all known fixation means known to the man skilled in the art. From the spaced apart fixation points 11 and 12 on the unit 5 the ropes 6 and 7 are guided towards an upper winding unit or device 9 and a lower winding unit or device 9'. The ropes are guided towards a common centre, so that the ropes and the holding means 5 form an upper triangle 6', 5, 7' and a lower triangle 6", 5, 7". The winding means carry a wound supply of each flexible member or rope 6 and 7, respectively, with the upper and with the lower winding unit. The winding units 9 and 9' are shown as boxes only in FIGS. 1 and 2 and shown in greater detail in FIGS. 3 to 5. Each winding unit comprises a driven means, for example a winch, allowing a winding or unwinding of the rope and its supply on the winding unit. This is indicated by the double arrows in each of box 9 and 9' symbolizing the winding units. The drives of the winches may be electric or pneumatic or hydraulic. Each winding unit 9 and 9', and more precisely the drive motors of their winches, are controllable by a control unit 10, for example an industrial controller or a personal computer. As can be easily seen in the simplified FIG. 1, the holding unit 5 can be lowered by unwinding rope from the upper winding means 9, so that sections 6' and 7' of ropes 6 and 7 become longer, while at the same time, and synchronized with this unwinding, rope is wound up on the lower winding unit in the same amount, so that sections 6" and 7" of the rope 6 and 7 become shorter. By such a lowering, the cleaning unit 4 is lowered in the container, so that it will move on an arc that is positioned lower on the inside wall and has not yet been cleaned. The lifting of the holding unit 5 and thus the cleaning unit 4 is done in the same way, but by winding-up rope by the upper winding means 9 and at the same time unwinding the same amount of rope by the lower winding means 9', so that the holding means is moved upwards in the container 3. By combining this lifting and/or lowering movement by the winding/unwinding of the ropes with the circumferential arc movement of the unit 4, the inside wall can be treated or cleaned, respectively, along its full cylindrical inside area. Further to the lifting and lowering by lengthening and shortening the rope sections on both ropes 6 and 7 the device allows the tilting of the holding unit 5 and thus the unit 4. To this end the rope 7 sections 7' and 7" connected at point 12 nearer to the unit 5 are lengthened or shortened while rope 6 sections 6' and 6" are kept constant in length or are changed less in length than the rope 7 sections. This can be clearly seen in FIG. 4, where a tilted position of holding unit is shown. If for example section 7' would be lengthened even more, while section 7" is shortened accordingly and sections 6' and 6" are kept constant in length, an increased tilt would occur. If on the other hand section 7' would be shortened and section 7" would be lengthened accordingly, the tilt shown would be reduced and could be changed to a tilt in the other direction as presently shown. Thus the device allows an easy tilting movement which can be used on the cylindrical inside wall of the container as shown in FIG. 4 but in particular allows an adaptation to the sloping inside walls of funnel shaped containers and in particular silos with a central lower opening as shown in FIG. 4. An extreme tilting is possible by adjusting the lengths of sections 7' and 7" accordingly, so that even funnel-shaped silos with a very narrow funnel can be cleaned. It is the necessary to tilt unit 4 as well, so that it contacts the inside wall correctly. This can be done by a joint between holding unit 5 and treatment unit 4 that can be actuated by actuation means or that passively allows an adaptation of unit 4 to the wall 2.

Rope 6 at the position opposite to the treatment unit 4 on the holding unit 5 is always kept under the tension necessary to press the holding unit 5 and thus unit 4 against the inside wall 2 of the container. This pressure results when the length of elongated member 5 is selected greater than the inside radius of the container, so that the rope 6 fixed on point 11 outside of the longitudinal axis of the container will exert a force in direction of arrow B if rope 6 is tensioned and therefore wants to straighten between the central point on top of the container and the central point on the bottom of the container, where the winding units are arranged.

Figure 2:
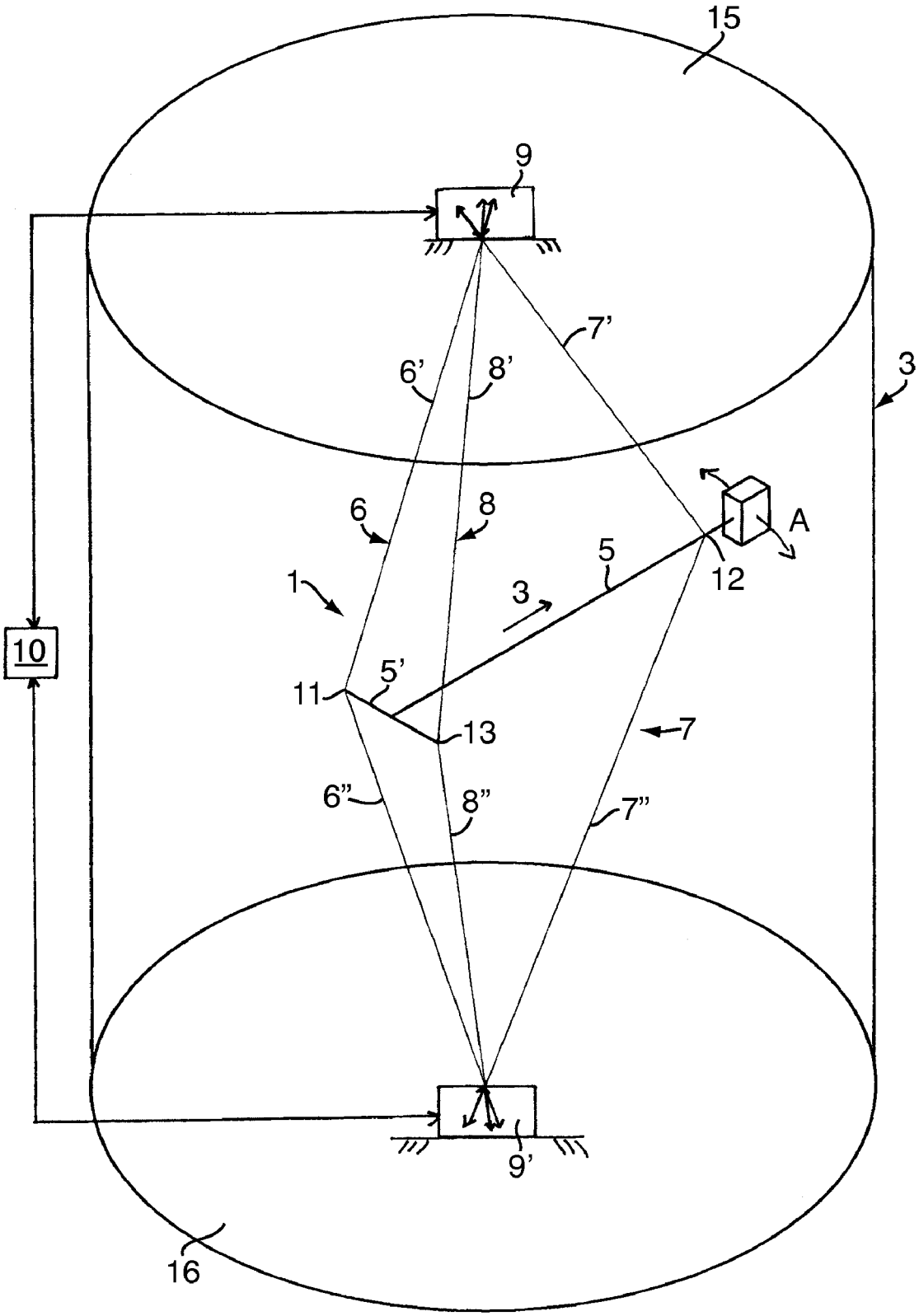
FIG. 2 is a view similar to the view of FIG. 1 of a second embodiment of the invention.

FIG. 2 shows another embodiment of the invention wherein same reference numerals depict same elements or functionally equivalent elements as discussed above. In this embodiment greater stability of the holding unit 5 is attained by using two spaced apart ropes 6 and 8 at the end of elongated unit 5. To attach these ropes spaced apart a transverse beam or rod 5', respectively is used in this embodiment. If the elongated unit 5 is plate-shaped in itself, no such member is necessary to attach the ropes in a spaced apart manner. Rope 6 with sections 6' and 6" is thus connected at point 11 and rope 8 with sections 8' and 8" is connected at point 13. Here as well, sections 8' and 8" can be two ropes each connected at point 13 or can be one rope connected at point 13 to unit 5. The lowering, lifting and tilting is done as explained in connection with FIG. 1, but of course rope sections 6' and 8' and 6" and 8"

have to be lengthened and shortened, respectively, in conformity and the winding means 9 and 9' must be equipped accordingly. In FIGS. 1 and 2 winding units 9 and 9' are shown as being arranged within the container on top and bottom thereof. However, an arrangement with winding units outside the container is preferred, as shown in the following Figures.

Figure 3:
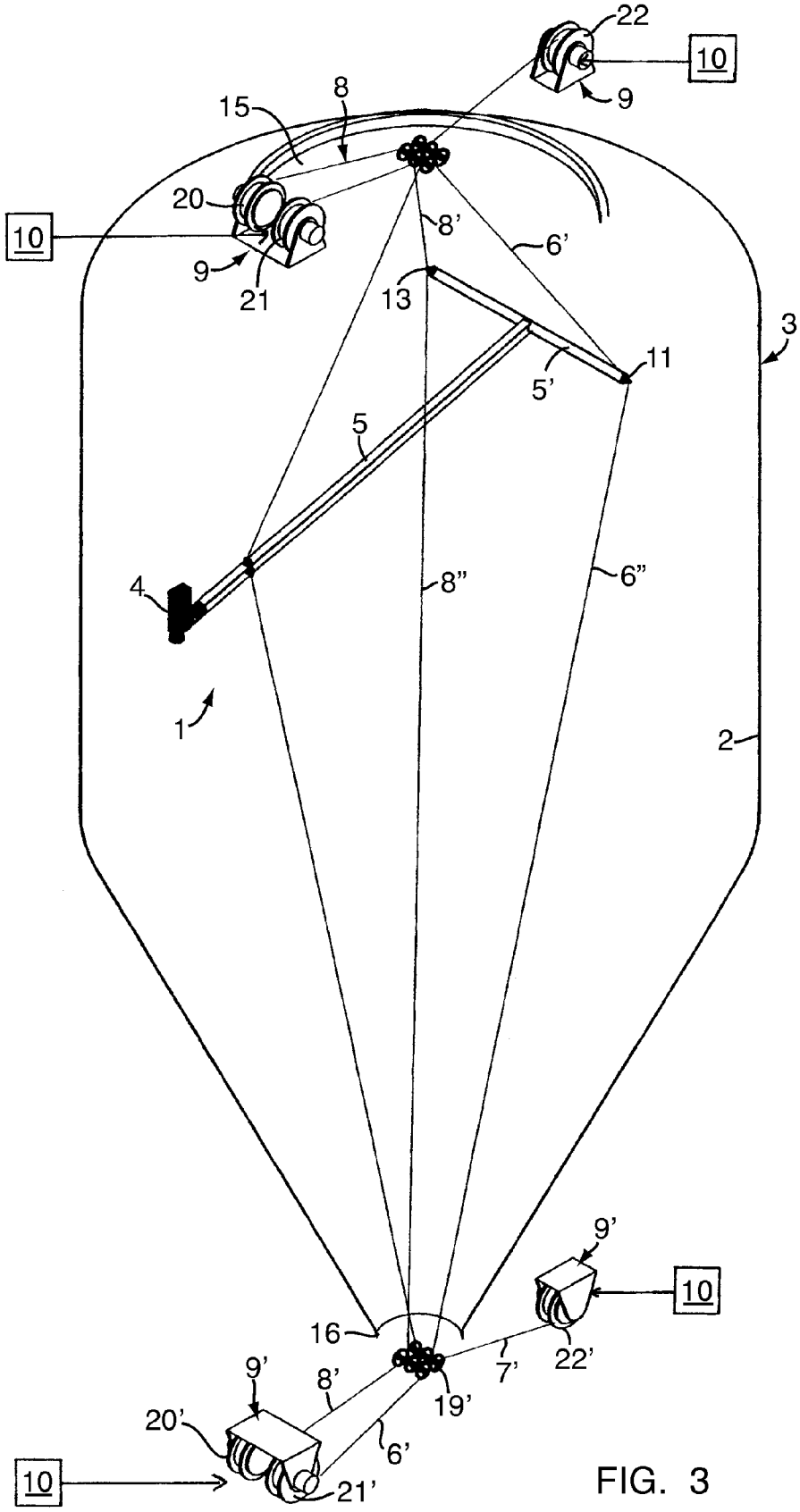
FIG. 3 is a three-dimensional view of the second embodiment showing more details.
Figure 4:
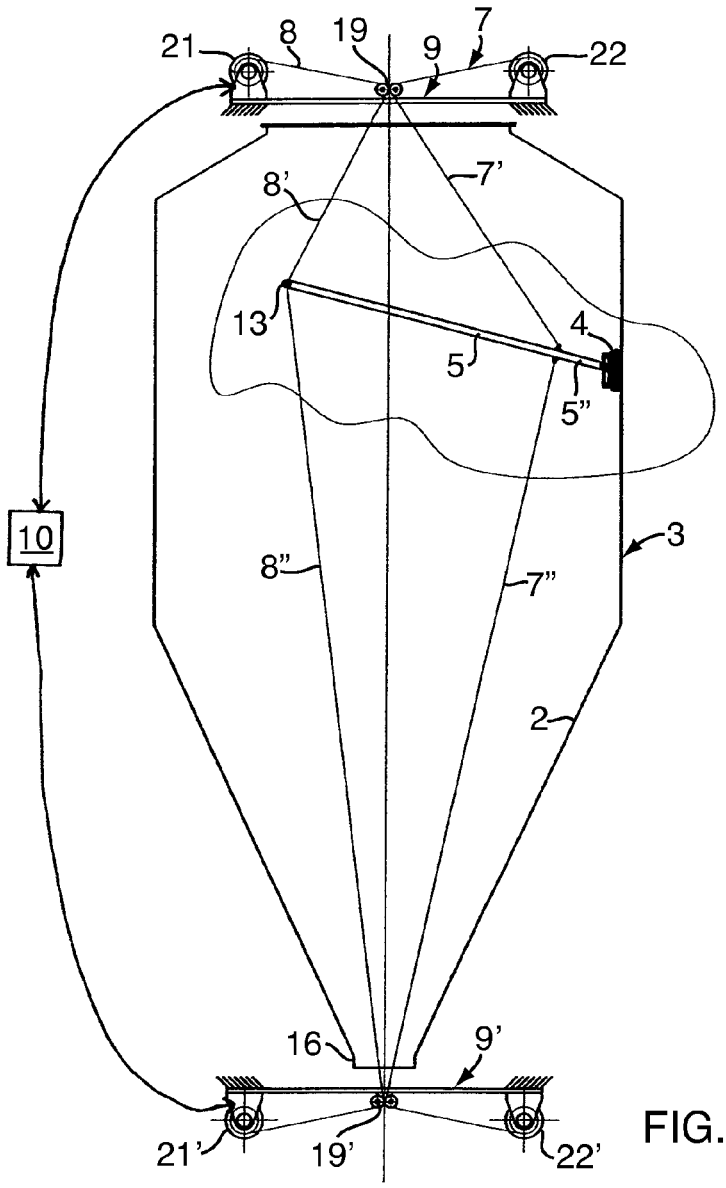
FIG. 4 is a side view of the second embodiment.
Figure 5:
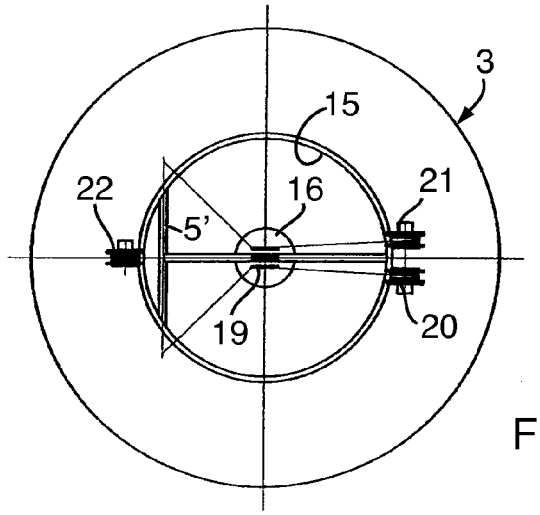
FIG. 5 is a top view of the second embodiment of the invention.

FIGS. 3, 4 and 5 show an embodiment according to FIG. 2 with the two ropes 6 and 8 in greater detail. Same reference numerals as used before show same or functionally equivalent elements. In particular the winding units 9 and 9' are shown in greater detail. In this embodiment the winding units are arranged outside the container top and bottom, so that the ropes leave the container through the top opening 15 and the bottom opening 16. The winding units are fixedly arranged outside of the container by attaching these units to the building where the container stands or to another structure allowing a fixation of the winding means. This fixation can be permanent, so that the winding units stay in place even when no cleaning is done and only the elements of the device within the container are removed during normal use of the container. The fixation of the winding units can be on the other hand only temporary, so that the winding units are removed as well during normal use of the container. Deflecting rollers 19 and 19' provide a central inlet for the ropes exiting the container. Other means could be used to this end, such as a funnel shaped central inlet, where the ropes are taken together and then run to winches 20, 21 and 22 on the top winding unit and to winches 20', 21' and 22' on the bottom winding unit. Winches are driven by motors or pneumatically under control of controller 10 in order to work as explained above. Thus lowering or lifting of unit 5 is effected by lengthening and shortening corresponding sections of the flexible members as explained above. Tilting occurs by lengthening/shortening of rope sections 7', 7", respectively, while keeping sections of ropes 6 and 8 constant in length or changing them less (or more) than rope sections 7', 7".

When cleaning is in progress, the ropes are twisted due to the fixed mounting of the winding means and the circumferential arc movement of the cleaning unit 4, which will usually be selected as 360° and is then reversed, so that the ropes are untwisted again. If other flexible members than ropes are used, such as belts, toothed belts, cables or wires, this twisting will occur as well and the flexible members must be selected to allow for such twisting. Even chains may be used as flexible members if it is allowed for the twisting by rotating joints. The twisting movement of the flexible members can be avoided when the winding means are arranged to rotate and counter rotate as well together with the circumferential arc movement of the cleaning unit. In a further embodiment the treatment unit 4 is connected to the holding unit 5 by a spring loaded (or driven by means other than a spring) telescopic member of the holding unit only indicated by reference numeral 5" in FIG. 4, which member is included in the length of the holding unit being equal or greater than the container radius and which forms an additional pressure means for pressing the treatment unit against the container wall. This telescopic member allows to have a pressure on the treatment unit 4 even if the tightened rope sections 6', 6" in the one embodiment or the tightened rope sections 6', 8', 6", 8" are running in the centreline of the container and thus exerting no pressure by being offset from the centerline, but by keeping the spring means or other means of the telescopic member under pressure nevertheless.

The device and the method for cleaning a container, a tank or a silo, is thus manifested in that it is provided with a cleaning unit 4 suspended by rope sections 6', 6", 7', 7" and between winding units 9, 9' comprising a wound supply of rope. By changing the length of the sections by the winding devices under control of a controller 10 the cleaning unit can be lifted and lowered, tilted and pressed against the inside wall of said container.

The invention claimed is:

1. A device for the cleaning of a container, a tank or a silo, comprising:

a hanging unit, the hanging unit including rope-like flexible members, a first winding unit and a second winding unit, each winding unit comprising a wound supply of said flexible members and being adapted to change the length of sections said flexible members under control of a control unit;

at least one elongated rigid holding unit connected to the hanging unit, the holding unit being held by the flexible members and suspended between the first and second winding units, the holding unit having a length equal or greater than the radius of the container; and a cleaning unit disposed on one end of the holding unit, the cleaning unit being adapted to face an inside wall of the container, wherein the cleaning unit is lifted and/or lowered and/or tilted, and pressed against the inside wall of said container, by lengthening and/or shortening said sections and tensioning at least one of said flexible members;

wherein the position of the holding unit between the first and second winding units and the tilt of the holding unit is adjustable by changing the length of the sections of the flexible members reaching from the first and second winding units to the holding unit under control of the control unit, and wherein the holding unit is movable toward the container wall by tensioning at least one of the flexible members between the first and second winding units, and wherein the cleaning unit is provided with a drive for displacing the cleaning unit along the container wall.

2. Device according to claim 1 wherein two flexible members are provided.

3. Device according to claim 1 wherein three flexible members are provided.

4. Device according to claim 1 wherein the first and second winding units are adapted to be rigidly mounted within a container.

5. Device according to claim 1 wherein the first and second winding units are adapted to be rigidly mounted outside of a container.

6. Device according to claim 1 wherein the flexible members are ropes or belts or toothed belts or wires or chains.

7. Device according to claim 1 wherein the first and second winding units comprise a central entry with deflection means for the flexible members and opposing winch means.

8. Device according to claim 1 wherein the rigid holding unit comprises a spring loaded telescopic section on which the cleaning unit is mounted.

9. Device according to claim 1 wherein the cleaning unit comprises a dry cleaning head.

10. Device according to claim 1 wherein the cleaning unit comprises a spraying or coating head.

11. A combination of a container and a treatment device, comprising:

a container having a top opening and a bottom opening, and a treatment device having a cleaning unit suspended within the container between a first winding unit and a second winding unit by sections of rope-like flexible members, the first winding unit being arranged outside of the container above the top opening and the second winding unit being arranged outside of the container below the bottom opening, each winding unit comprising a wound supply of said flexible members and being adapted to change the length of the sections under control of a controller, so that the cleaning unit is lifted and/or lowered and/or tilted, and pressed against the inside wall of said container, by lengthening and/or shortening said sections and tensioning at least one of said flexible members.

12. A method for the cleaning of the inside wall of a container, a tank or a silo, comprising the steps of suspending at least one rigid holding unit holding a cleaning unit, by a hanging unit connected to the holding unit with rope-like flexible members, the hanging unit including a first winding device and a second winding device for the flexible members, said holding unit being held by the flexible members and suspended between the first and second winding devices, and using a control unit to control the first and second winding devices to adjust the position of the holding unit between the first and second winding devices and/or the tilt of the holding unit by changing the length of sections of the flexible members reaching from the first and second winding devices to the holding unit;

using a control unit to control the first and second winding devices to press the cleaning unit to the container wall by tensioning at least one of the flexible members by the first and/or second winding devices; and using a control unit to control a drive arranged on the cleaning unit to drive the cleaning unit along an arc length of the container wall and back.

13. Method according to claim 12 wherein two flexible members are provided.

14. Method according to claim 12 wherein three flexible members are provided.

15. Method according to claim 12 wherein at least one of the first and second winding devices is rigidly mounted within the container.

16. Method according to claim 12 wherein at least one of the first and second winding devices is rigidly mounted outside of the container.

17. Method according to claim 12 wherein the flexible members are ropes or belts or wires or chains.

18. Method according to claim 12 wherein the first and second winding devices comprise a central entry with deflection means for the flexible members and winch means opposing each other.

19. Method according to claim 12 wherein the cleaning unit is driven along a circumferential arc path for a selected angle and is then reverse driven for the same angle.

20. Method according to claim 12 wherein the cleaning unit is pressed against the container wall by additional pressure means.

21. A method for the cleaning of the inside wall of a container, a tank or a silo, comprising the steps of suspending a cleaning unit by sections of rope-like flexible members between winding units comprising a wound supply of said flexible members, and changing the length of the sections by the winding devices under control of a controller, so that the cleaning unit is lifted and/or lowered, tilted and pressed against the inside wall of said container by lengthening and/or shortening said sections and tensioning at least one of said ropes;

wherein the cleaning unit is driven along a circumferential arc path for a selected angle and is then reverse driven for the same angle.

* * * * *